US011111892B2

(12) United States Patent
Schoefbaenker et al.

(10) Patent No.: US 11,111,892 B2
(45) Date of Patent: Sep. 7, 2021

(54) DEVICE FOR SENSING THE STATE OF AN INJECTOR

(71) Applicant: LIEBHERR-COMPONENTS DEGGENDORF GMBH, Deggendorf (DE)

(72) Inventors: Norbert Schoefbaenker, Ohlsdorf (AT); Richard Pirkl, Regensburg (DE); Lorand D'Ouvenou, Regensburg (DE)

(73) Assignee: LIEBHERR-COMPONENTS DEGGENDORF GMBH, Deggendorf (DE)

( * ) Notice: Subject to any disclaimer, the term of this patent is extended or adjusted under 35 U.S.C. 154(b) by 67 days.

(21) Appl. No.: 16/632,526

(22) PCT Filed: Jul. 20, 2018

(86) PCT No.: PCT/EP2018/069796
§ 371 (c)(1),
(2) Date: Jan. 20, 2020

(87) PCT Pub. No.: WO2019/016380
PCT Pub. Date: Jan. 24, 2019

(65) Prior Publication Data

US 2020/0256297 A1 Aug. 13, 2020

(30) Foreign Application Priority Data

Jul. 20, 2017 (DE) ..... 10 2017 116 379.4

(51) Int. Cl.
*F02D 41/22* (2006.01)
*F02M 51/06* (2006.01)
(Continued)

(52) U.S. Cl.
CPC ..... *F02M 51/06* (2013.01); *F02M 51/005* (2013.01); *F02M 55/025* (2013.01); *F02M 61/10* (2013.01); *F02M 61/14* (2013.01)

(58) Field of Classification Search
CPC .... F02M 51/06; F02M 51/005; F02M 55/025; F02M 61/10; F02M 61/14; F02M 61/16;
(Continued)

(56) References Cited

U.S. PATENT DOCUMENTS 4,292,948 A * 10/1981 Graessley ..... F02D 41/20 123/490
4,492,913 A * 1/1985 Arnold ..... F02D 41/20 123/472
(Continued)

FOREIGN PATENT DOCUMENTS

DE 10256456 A1 7/2004
DE 10333358 B3 5/2005
(Continued)

OTHER PUBLICATIONS

ISA European Patent Office, International Search Report Issued in Application No. PCT/EP2018/069796, dated Oct. 15, 2018, WIPO, 6 pages.

*Primary Examiner* — Thomas N Moulis
(74) *Attorney, Agent, or Firm* — McCoy Russell LLP

(57) ABSTRACT

The invention relates to a device for sensing the state of an injector, comprising an injector for injecting fuel into an engine combustion chamber, a switch, which is designed to change the switching state thereof in accordance with the state of the injector, and an evaluating unit for sensing the switching state of the switch, wherein a first switch contact of the switch is connected to an electrical input line of the injector, a second switch contact of the switch is connected to ground, and the evaluating unit is designed to carry out a first current measurement for a current flowing into the
(Continued)

injector and into the switch and a second current measurement for the current flowing into the injector.

16 Claims, 4 Drawing Sheets

(51) Int. Cl.
*F02M 51/00* (2006.01)
*F02M 55/02* (2006.01)
*F02M 61/10* (2006.01)
*F02M 61/14* (2006.01)

(58) Field of Classification Search
CPC ..... F02D 41/20; F02D 2041/2068; F02D 2041/2086; F02D 2041/2089; F02D 2041/2093; F02D 41/22; F02D 41/222
See application file for complete search history.

(56) References Cited

U.S. PATENT DOCUMENTS 4,612,597 A * 9/1986 Hamren ..... F02D 41/20 123/490
4,631,628 A * 12/1986 Kissel ..... F02D 41/20 123/490
4,736,267 A * 4/1988 Karlmann ..... F02D 41/20 123/490
5,650,909 A * 7/1997 Remele ..... F02D 41/20 361/154
5,687,050 A * 11/1997 Bartsch ..... F02D 41/20 123/490
6,120,005 A * 9/2000 Wright ..... F02D 41/20 251/129.09
6,122,158 A * 9/2000 Weber ..... F02D 41/20 361/154
6,367,719 B1 * 4/2002 Wright ..... F02D 41/20 123/490
8,196,566 B2 * 6/2012 Matsuura ..... F02D 41/20 123/490
11,008,988 B2 * 5/2021 Sugiyama ..... F02D 41/22
2009/0314073 A1 * 12/2009 Perryman ..... F02D 41/2096 73/114.45
2011/0100333 A1 * 5/2011 Toyohara ..... F02D 41/20 123/490
2012/0227710 A1 * 9/2012 Bolz ..... F02D 41/20 123/490
2014/0095052 A1 * 4/2014 Frohlich ..... F02D 19/025 701/103
2014/0117121 A1 * 5/2014 Nong ..... F02M 51/061 239/584
2014/0190453 A1 * 7/2014 Qiao ..... F02M 51/005 123/478
2016/0319763 A1 * 11/2016 Shen ..... F02D 41/20
2018/0156148 A1 * 6/2018 Nishimura ..... F02D 41/30
2020/0056570 A1 * 2/2020 Sugiyama ..... B60R 16/02
2021/0126521 A1 * 4/2021 Biellmann ..... F02D 41/3005

FOREIGN PATENT DOCUMENTS

DE 102005007327 A1 8/2006
DE 102015219673 A1 4/2017
DE 102015225733 A1 6/2017
EP 1596055 A1 11/2005
EP 3124777 A1 2/2014
WO 2004085826 A1 10/2004
WO 2013000834 A1 1/2013
WO 2015071132 A1 5/2015
WO 2016012242 A1 1/2016

* cited by examiner

DEVICE FOR SENSING THE STATE OF AN INJECTOR

CROSS-REFERENCE TO RELATED APPLICATIONS

The present application is a U.S. National Phase of International Application No PCT/EP2018/069796, entitled "DEVICE FOR SENSING THE STATE OF AN INJECTOR", and filed on Jul. 20, 2018. International Application No. PCT/EP2018/069796 claims priority to German Patent Application No. 10 2017 116 379.4, filed on Jul. 20, 2017. The entire contents of each of the above-listed applications are hereby incorporated by reference for all purposes.

TECHNICAL FIELD

The present invention relates to a device for the state detection of an injector, and to an injector having a corresponding state detection, as well as to a method of determining an injector state.

BACKGROUND AND SUMMARY

Injection nozzles or injectors typically serve to inject a fuel into a combustion chamber of an engine. It is of advantage here for an engine in which such an injector is present if a control device is informed of the exact opening time of the injector so that, for example, a particularly tight tolerance band is present for the injection quantity of the fuel output by the injector, which is also advantageous with respect to the total product service life of the injector.

It is additionally advantageous for a plurality of control functions or monitoring functions of the engine if the exact injection time at which the injector outputs a fuel is known.

It is known from the prior art to use an electrical switch for a state detection of the injector. The switch here is closed when the injector is not energized and the valve needle of the injector does not move or ensures that no fuel exits the injector. As soon as the valve needle moves out of its valve seat, the electrical switch changes its state, that is, it moves into an open state or into a closed state. The switch changes its state again when the valve needle moves into the valve seat again.

In the simplest form of the state detection of an injector, a total of four lines lead into the housing of the injector in which the switch is also arranged. Two lines would be provided for the injector itself, whereas the other two lines would be associated with the switch. The high wiring effort with a unit of such a design is, however, disadvantageous here.

If a 3 pole or 4 pole plug is used, that is, if 3 or four lines run to the injector having the switch, no additional effort is required at the detection circuit. On the other hand, this means an additional effort at the injector due to the plurality of elements and to the connection components having to be dimensioned larger.

In a modification of this form likewise known from the prior art, the switch contacts are arranged not directly accessible or isolated in the housing of the injector. Such a representation is shown in FIG. 1. In this respect, a pole of the switch is connected via a resistor to a pin of the injector or of a solenoid valve actuating the injector. The other pole of the switch is furthermore connected to the housing of the injector. In this respect, the injector itself is connected to the ground in the normal case that can, for example, be the engine block on a use in a vehicle. In such an implementation, only two cables or lines lead out of the housing.

In a normal operation, a voltage is applied to the injector or to the solenoid valve actuating the injector, whereby a mechanical and/or hydraulic movement of the valve needle is triggered. The movement of the valve needle in turn opens or closes the switch. Provision can thus be made, for example, that the switch is closed by removing the voltage.

It is problematic with this kind of state detection that an indefinite time delay can be present between an application/removal of the voltage at the injector or at the solenoid valve and the switch triggering, that is, the movement of the valve needle out of its seat or back into its seat, since the mechanical and/or hydraulic movement of the valve needle has a certain inertia. It can thus occur under certain circumstances that the switch opens when the voltage is still applied to the injector or to the solenoid valve or, in the event of a long delay, the switch only opens when the voltage has already been removed again. An analog behavior can also occur on closing. A voltage can thus be applied, or also not be applied, at the injector or at the solenoid valve during the closing phase.

Irrespective of the disadvantages listed above, the current through the switch is measured for a detection of the switch state that in turn permits a conclusion on an injection state or a closed state of the injector. It must be taken into account in this respect that the switch cannot be loaded by high currents and is restricted to just a few mA with the help of the resistor for reasons of efficiency.

As long as the injector or the solenoid valve is not activated, the output voltage (typically the vehicle battery voltage of 12 or 48 volts) has to be applied via the pin by the injector or the solenoid valve (coil) that is connected to the switch. FIG. 2 shows the case that the current flow for the just described situation is detected with the aid of a measurement circuit (not shown). As an example, a current of 10 mA was assumed here that flows through the resistor and the switch. The state can accordingly be recognized that results when the injector is not energized, but the switch is closed.

As soon as the injector or the solenoid valve is operated at the same time as the switch, an additional current of some amperes has to be fed into the injector or the solenoid valve. FIG. 3 shows such a situation. As an example, a typical value of 10 A was assumed here for the current flowing through the injector or the solenoid valve.

It is known from the prior art to carry out a current measurement at the input line of the arrangement. It is relatively simple here to distinguish between the states "de-energized" and "switch closed with a non-energized injector/solenoid valve". However, it is a great challenge if high currents (e.g. 10 A) flow through the injector or the solenoid coil and only increase by a few mA as soon as the switch closes. The detector has to be very sensitive due to the only small current change.

A jump from 0 mA to 10 mA can be easily detected. However, the change from 10 A to 10.01 A is more difficult since the relative current increase here only amounts to 0.1%. If the resolution of the detection circuit is now not high enough, there is a risk that this small increase is perceived as interference or as noise in the current. At least a 10 bit system is required as the minimum requirement in a digital system for a 0.1 percent resolution. In this respect, a percentage variation of 0.1 would signify the minimal uncertainty due to the system resolution. It is thus not possible with such a high resolution system that a reliable distinction without error can be made between a real change of the value and interference or noise in the current. In addition, a filter connected downstream is necessary to increase the detection safety.

It results from this that a particularly high resolution system having signal filtering has to be used for the current measurement that causes a disruptive time delay as an unwanted side effect due to the filtering. It is therefore the object of the present invention to overcome the disadvantages of the prior art listed above and to provide a device for the state detection of an injector that is advantageous with respect to the known prior art.

This is done by a device in accordance with claim 1 with which signal filtering is not necessary and an expensive high resolution current measurement is also no longer required. The present invention further also enables a clear detection of the switch state in noisy environments that result in fluctuations in the current. In addition, it is furthermore possible with the invention to operate an injector with only two line cables conducted out of the housing receiving the injector. The presence of a third or even of a fourth line cable is no longer necessary despite the state detection by a low resolution ammeter.

The device in accordance with the invention for the state detection of an injector here comprises an injector for injecting fuel into an engine combustion chamber, a switch that is configured to change its switch state in dependence on a state of the injector, and an evaluation unit for detecting the switch state of the switch, wherein a first switch contact of the switch is connected to an electrical input line of the injector and a second switch contact of the switch can be connected to ground. The device in accordance with the invention is further characterized in that the evaluation unit is adapted to carry out a first current measurement for a current flowing into the injector and into the switch and a second current measurement for the current flowing into the injector.

A current measurement is here understood as any measurement that allows a conclusion on the current flowing in a line. In this respect, it is not absolutely necessary to measure the current directly.

The invention thereby provides a solution on how an injector can be operated with two cables and how at the same time they can here be used to detect the switch state without uncertainties due to signal noise and restricted resolution. In contrast to the already known prior art in which the current or the voltage is measured in absolute terms and this measured value is compared with a predetermined level (10 A or 10.01 A), the present invention uses a difference measurement. The current flowing into the injector (or into the housing receiving the injector) and the current flowing back out of the injector are measured here. A state detection of the injector is possible with the aid of an evaluation taking account of the two measured values in which all the interference factors superposed on the current flow are eliminated so that a particularly exact detection of the switch state is possible.

This is preferably possible when the evaluation unit is further adapted to determine the switch state of the switch on the basis of a difference of the measured values between the first current measurement and the second current measurement. All the superposed signals are automatically eliminated by the difference of the two values. The result is then only the current flowing through the switch. The advantage can thus be achieved that all the interference signals and offset currents are eliminated, unlike the asymmetrical measurement used in the prior art. Interference influences both current measurements to the same degree so that it is not important as a result due to a subsequent difference formation. If the switch is closed, a very small signal, that can, however, be easily detected, results after the difference formation.

The manner how the state of the switch is detected is here inventive with respect to the prior art. Instead of measuring the absolute voltage with the support of a pull-up or pull-down resistor or of measuring the current in absolute terms and in so doing attempting to identify the increase for the state change of the switch, the current that flows in the direction of the injector and that flows back out of it again is measured symmetrically. The difference of these two measured values is used as an indicator for the state change of the switch. It is of advantage here that the symmetrical measurement eliminates superposed interference currents and noise. A value is received as the result here that corresponds to the current through the switch. A filtering of this result connected downstream can be dispensed with in the ideal case.

In accordance with an optional further development of the invention, the injector is adapted to change between an injection state and a closed state, with the switch furthermore adopting a first switch state on an injection state of the injector and a second switch state on a closed state of the injector. Provision can thus be made, for example, that the switch adopts a closed state on an injection state of the injector in which the jet needle moves or has moved into an extended state. If in contrast the jet needle returns into its originally set back position in which no fuel is output by the injector, the switch moves into an open state.

The state of the switch accordingly depends on the state of the injector.

Provision can preferably be made here that the first switch contact is connected to the input line of the injector via a resistor.

It is thus ensured that the current flowing in a closed state of the switch can be set to a small value so that the total energy efficiency does not suffer excessively thereunder. Care must be taken here that the first current measurement is carried out before the linking point of the line leading to the resistor. It must be ensured here that both the current flowing through the switch and also the current flowing through the injector are measured with the first current measurement.

Provision can furthermore be made that the second switch contact is connected to the same ground as a current circuit of the injector; the ground is preferably the body or an engine block of a vehicle. The connection of the second switch contact to the ground can here also take place via a connection to a housing of the injector that is in turn connected to ground. An injector housing can thus be provided that only has two outwardly led cables or contacts that permit a particularly simple handling.

Provision can furthermore be made that the evaluation unit furthermore has a filter to filter a difference of the two measured values obtained by the first current measurement and the second current measurement.

This makes possible a simpler determination of whether the switch is in a specific state or not.

In accordance with an optional further development of the invention, the injector and the switch are arranged in a common housing that comprises an input line, an output line, and a ground. Since the ground of an injector is frequently also embodied with the aid of a receiver of the claimed device or of the housing, the housing only has exactly two outwardly led contacts (such as lines, plug contacts, or the like) under certain circumstances.

In accordance with an advantageous embodiment of the invention, the first current measurement of the evaluation unit is arranged at the input line and the second current measurement of the evaluation unit is arranged at the output line of the housing.

It is thereby ensured that the achievable advantages of the present invention can be obtained with the measured current values.

The ground of the housing is here preferably connected to the second contact of the switch.

Provision can additionally be made that the injector is a solenoid valve injector in which a solenoid valve is preferably adapted to initiate a state change of the injector that in turn also effects a state change of the switch.

In accordance with a preferred embodiment of the invention, the switch changes its state due to a movement of an injector component, preferably due to a movement of a valve needle of the injector.

Provision can furthermore be made in accordance with a further development of the invention that the injector is a common rail injector.

The invention additionally relates to a method for the state detection of an injector in accordance with the preamble of claim 1, wherein in the method the sum of a current flowing into the injector and a current flowing into the switch is measured by a first current measurement, only the current flowing through the injector is measured by a second measurement, and a conclusion is drawn on the current actually flowing through the switch from a difference of the first current measurement from the second current measurement.

Provision can furthermore be made that the result of the difference of the first current measurement from the second current measurement is subjected to a filtering.

The invention further relates to an internal combustion engine in accordance with one of the methods discussed above.

BRIEF DESCRIPTION OF THE FIGURES

Further advantages, features, and details of the present invention will become clear on the basis of the following description of the Figures. There are shown.

DETAILED DESCRIPTION

Figure 1:
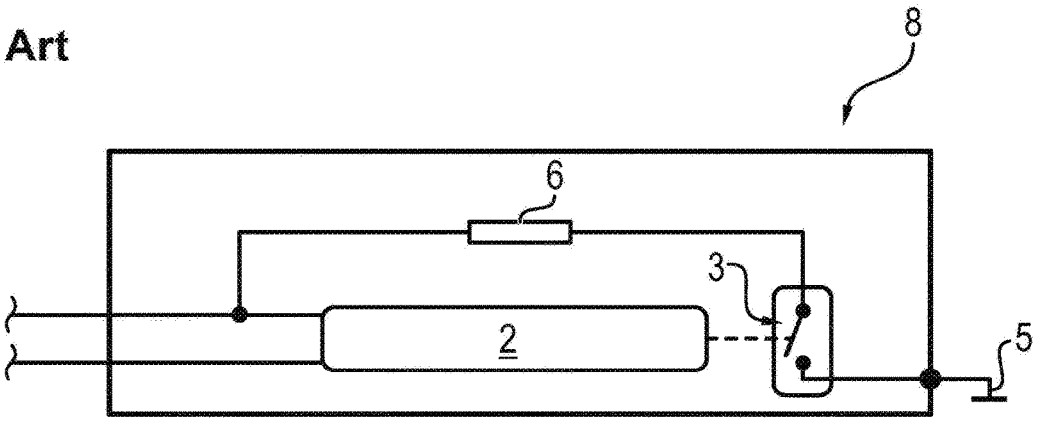
FIG. 1 Prior Art
FIGS. 1-3: schematic representations to explain the already known prior art.
Figure 2:
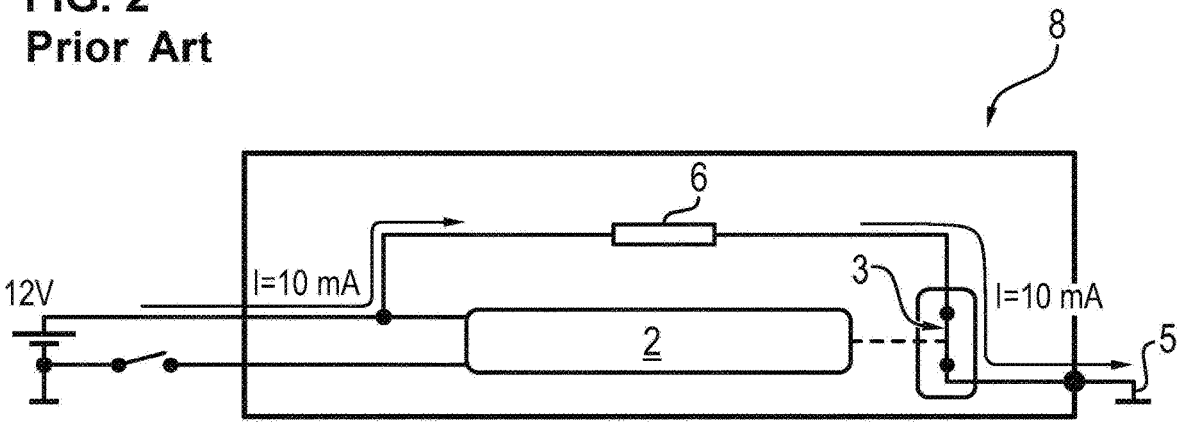
FIG. 2 Prior Art
Figure 3:
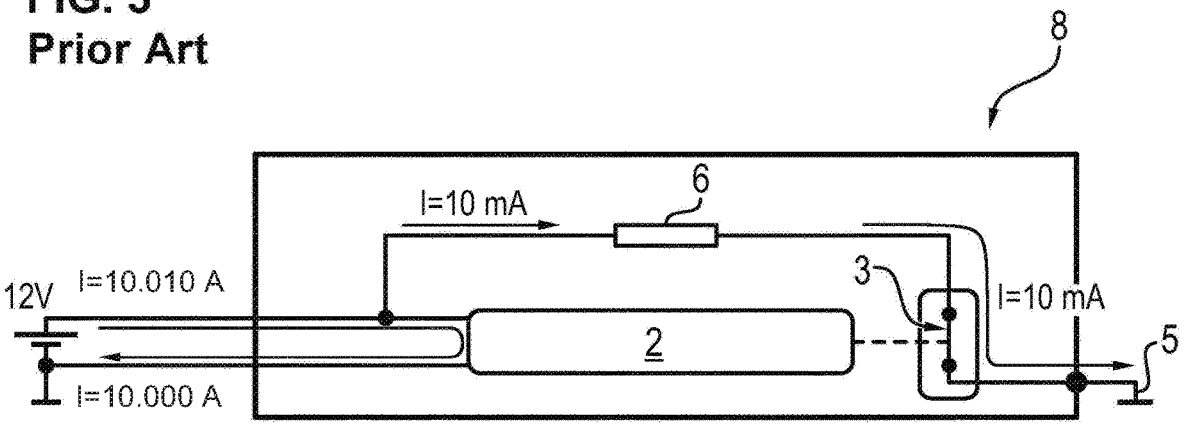
FIG. 3 Prior Art

FIGS. 1 to 3 were already explained in the introductory part of the description. In this respect, reference numeral 2 shows an injector that closes or opens a switch 3 on a change of its state. A first contact of the switch 3 is here connected to one of the two lines emanating from the injector 2 via a resistor 6. This has the result that on a closed state of the switch 3, a current flows through the resistor 6 that flows to ground 5 via the housing 8 of the device.

Exemplary values for the flowing current are drawn in FIG. 2 and FIG. 3. FIG. 2 thus shows the state in which the injector 2 is not energized, but the switch 3 is in a closed state. A current of 10 mA accordingly flows through the switch 3 by a corresponding design of the resistor 6.

In contrast, FIG. 3 shows the state in which the injector 2 is energized and the switch 3 is also closed. It can be recognized that 10 A also flow through the injector 2 in addition to the 10 mA that flow through the resistor 6 and the switch 3 to ground 5. If information were now required on the switch state, it was usual in the prior art to determine the inflowing current that is a combination of current flowing through the switch and current flowing through the injector 2. The disadvantages discussed in more detail in the introductory part of the description result in this respect.

Figure 4:
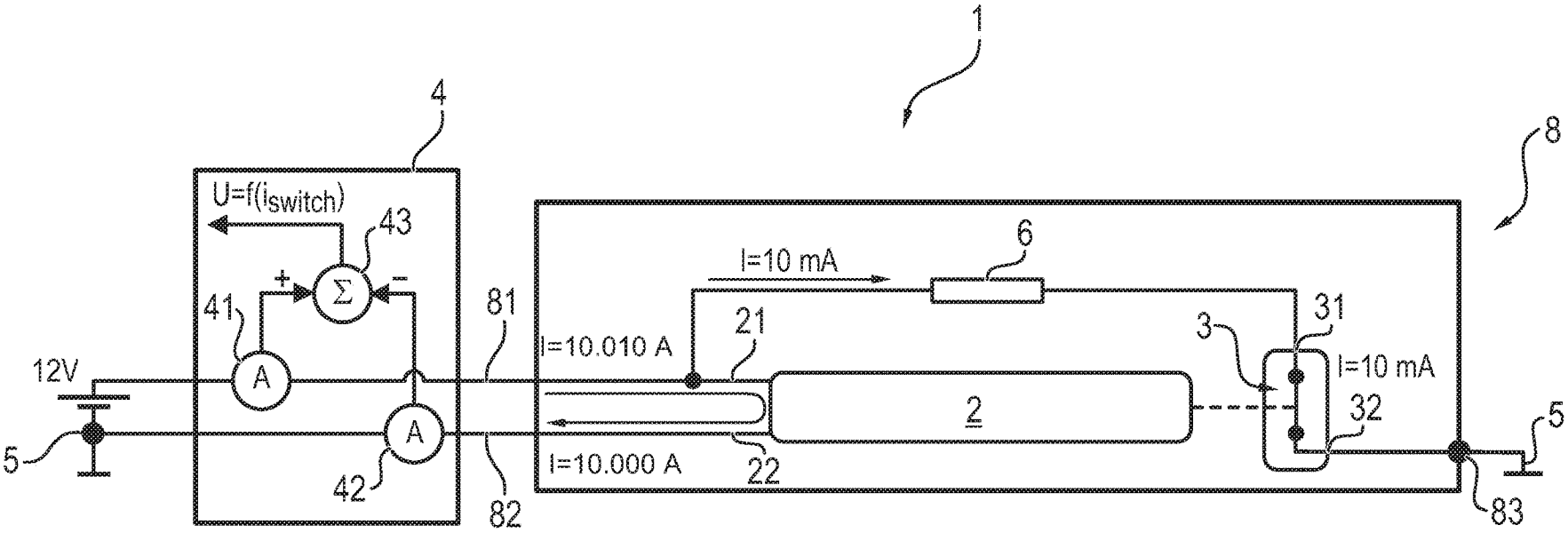
FIG. 4: a schematic representation of the device in accordance with the invention.

FIG. 4 shows a schematic representation of the present invention. The device 1 in this respect has an injector 2 that is suitable to discharge fuel into a combustion chamber in a metered manner. For this purpose, the injector 2 can adopt a first state in which no fuel exits and a second state in which fuel is discharged. If the injector 2 is in the second state in which fuel is discharged, a switch 3 is closed. Since a first contact 31 of the switch 3 is connected to a current supply line 21 of the injector 2 via a resistor 6, a current flow results from the energy source of the device 1 in the direction of ground 5 and runs through the switch 3. The second contact 32 of the switch 3 is connected to ground 5 via connection 83. The connection 83 can here take place via the housing 8 of the device 1 that is connected to ground 5. It is thus not necessary that a further line has to be provided that is led out of the housing 8. This improves the handling of the device 1 and reduces the number of components susceptible to error. The second contact 32 of the switch 3 is here only connected to the outer housing 8 of the device 1.

Two lines 81, 82 run from the housing 8, with the first line 81 having a branch to the resistor 6 between the housing 8 and the current input of the injector 2. The second line 82 running out of the housing 8 here connects the ground 5 to the current output of the injector 2.

A respective current measurement 41, 42 is furthermore provided at these two lines 81, 82. The results of the two current measurements 41, 42 are supplied to a difference module 43 that outputs the amount of the difference of the two measured values as the result. It is thereby possible that the relatively small current that flows through the switch 3 can be simply detected on a presence of noise or other superpositions on the current.

Provision can also be made that the evaluation unit 4 is integrated in the housing 8.

Figure 5:
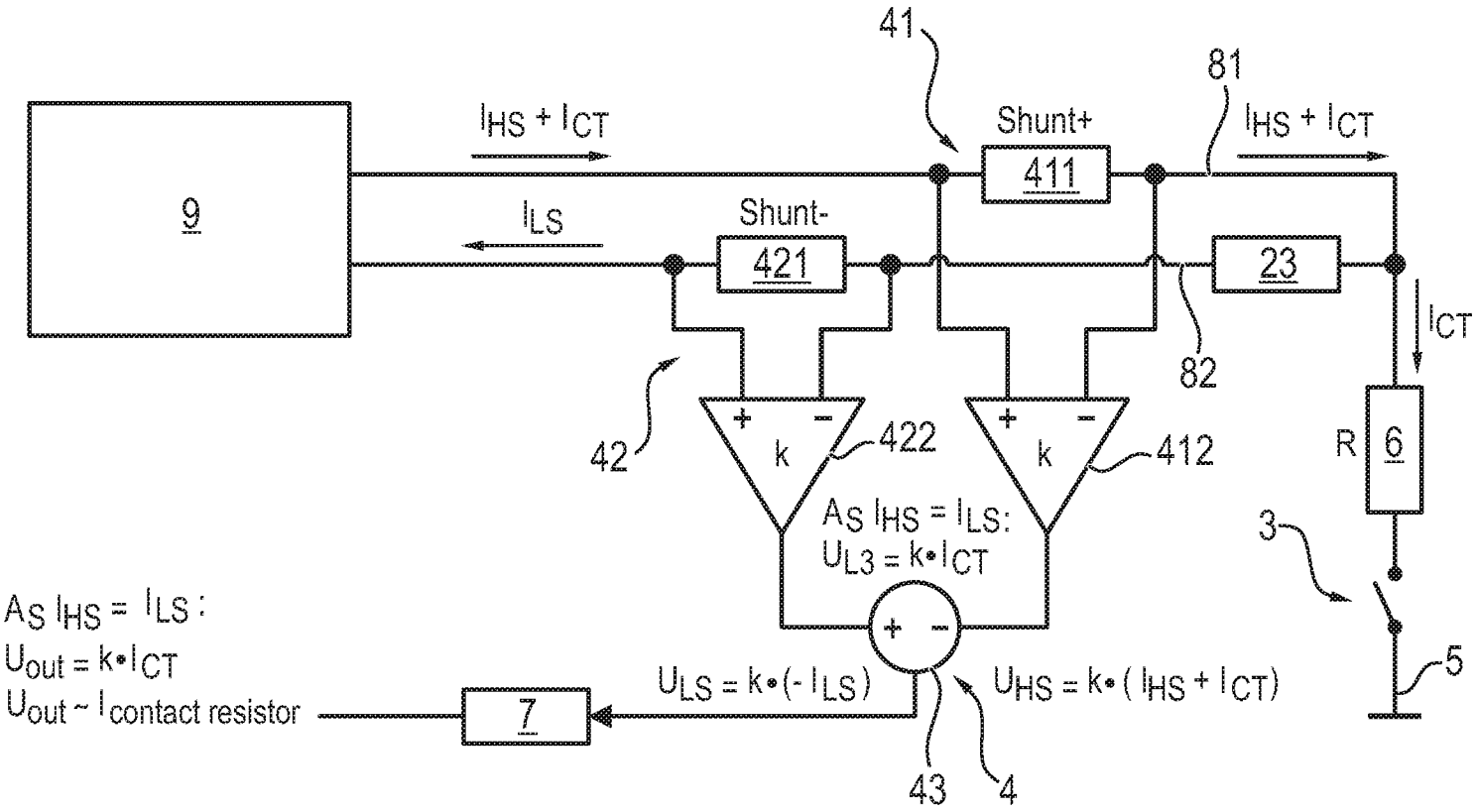
FIG. 5: a first specific embodiment of the present invention in a schematic representation.

FIG. 5 shows a specific implementation of the present invention. The current here is output, starting from a control logic 9, in the direction of an injector, that for reasons of simplicity is shown as an injector coil 23 in the present case, and of the resistor 6. Before a division of the current into the current through the resistor in the direction of ground 5 and the current through the injector coil 23 in the direction of ground 5, the current is measured with the aid of a shunt resistor 411 and an operational amplifier 412. This first current measurement 41 here measures both the current $I_{CT}$ flowing through the resistor 6 and the current $I_{HS}$ flowing through the injector.

The second current measurement 42 here likewise takes place with the aid of a shunt resistor 421 in which the current flowing therethrough is determined by a further operational amplifier 422. The two operational amplifiers 412 and 422 here have the same amplification factors k. In addition, the two outputs of the operational amplifiers (OPV) 412 and 422 are given to a difference module 43. It is thus possible to determine the voltage difference of the voltage dropping over the two shunt resistors 411 and 421 and to forward its difference to a filter 7. Since the voltage that drops over the shunt resistors 411 and 421 and that is amplified by the factor k by the two OPVs 412 and 422, is substantially proportional to the current flowing through the shunt resistor, a measure thus results for the current flow in which the respective shunt resistor 412 and 422 is positioned.

Figure 6:
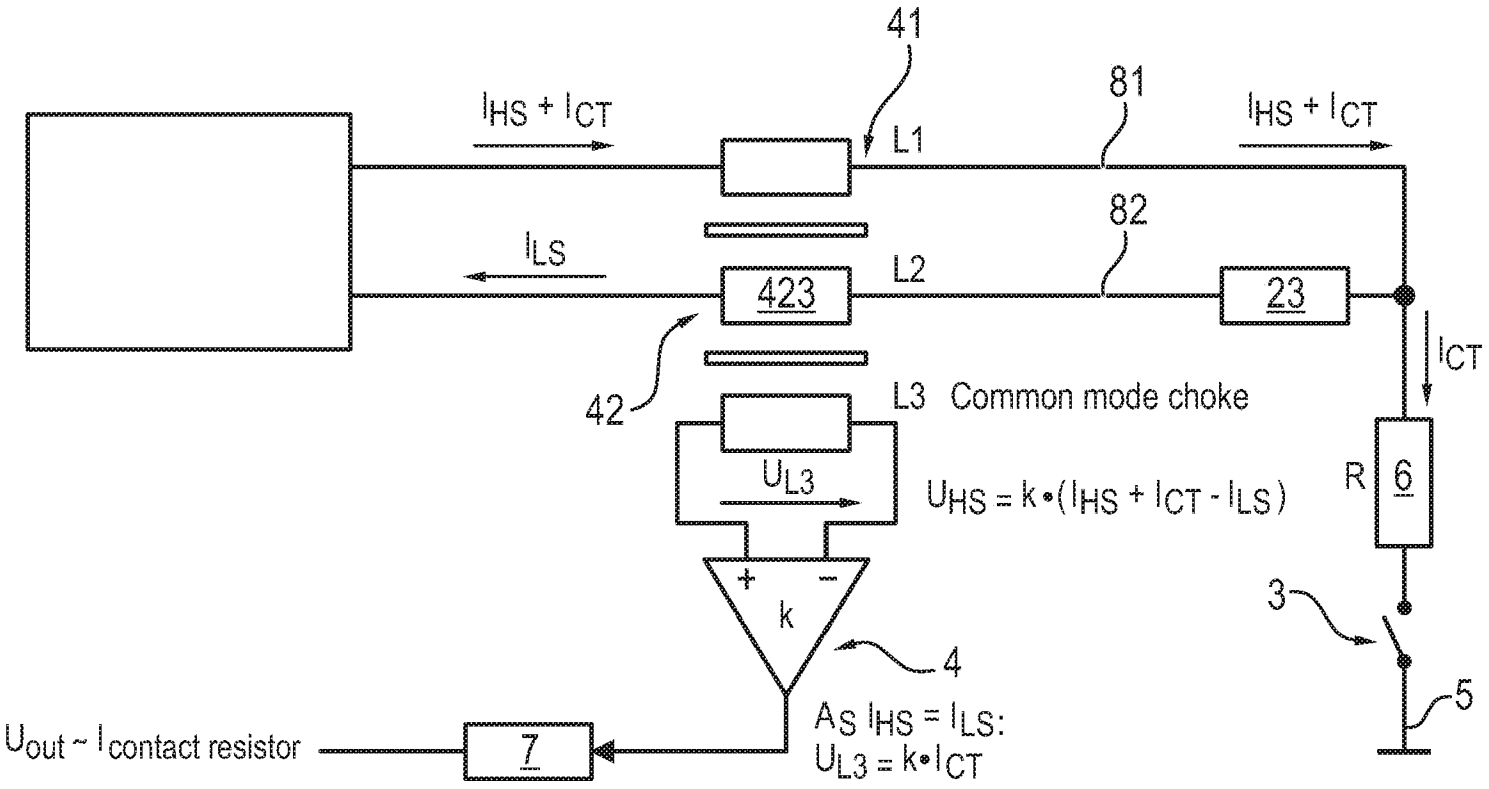
FIG. 6: a second specific embodiment of the present invention in a schematic representation.

FIG. 6 shows a further embodiment of the invention with a transformer. A transformer 423 can also be used as an alternative to the measurement by operational amplifiers 412 and 422. This only works with alternating current, but is also able to detect the time of the switch actuation of the switch 3. In this respect, the polarity of the impulse from the transformer 423 would indicate the opening or closing of the switch 3.

The general functional principle of the schematic implementation shown in FIG. 6 here does not differ from the solutions described in detail above so that a detailed description can be dispensed with.

It is additionally clear to the skilled person that a detection can be performed by a plurality of different circuits of which only a few very specific ones have been shown.

If the injector is not energized, the detection does not work. For example when all the currents have already decayed, but the injector is still open due to the inertia. The closing time would not be able to be detected in such a case.

This can be solved in that a small current is fed from the onboard network voltage into the injector via a resistor on the injector line to which the resistor is connected. A current of a few mA is likewise sufficient in this respect that flows permanently as an "offset current" and thus also enables a detection at any time, even if the injector is not even controlled.

The invention claimed is:

1. A device for state detection of an injector comprising:

an injector for injecting fuel into an engine combustion chamber;

a switch that is adapted to change its switch state in dependence on a state of the injector; and an evaluation unit for detecting the switch state of the switch, wherein a first switch contact of the switch is connected to an electrical input line of the injector; and a second switch contact of the switch is connected to ground, and the evaluation unit is adapted to carry out a first current measurement for a current ($I_{HS}$, $I_{CT}$) flowing into the injector and into the switch and a second current measurement for the current ($I_{LS}$) flowing into the injector.

2. The device in accordance with claim 1, wherein the evaluation unit is further adapted to determine the switch state of the switch based on a difference of the measured values between the first current measurement and the second current measurement.

3. The device in accordance with claim 1, wherein the injector is adapted to change between an injection state and a closed state; and wherein the switch adopts a first switch state on the injection state of the injector and a second switch state on the closed state of the injector.

4. The device in accordance claim 1, wherein the first switch contact is connected to the input line of the injector via a resistor.

5. The device in accordance with claim 1, wherein the second switch contact is connected to the same ground as a current circuit of the injector and the ground is the body or an engine block of a vehicle.

6. The device in accordance with claim 1, wherein the evaluation unit further comprises a filter to filter a difference of the two measured values obtained by the first current measurement and the second current measurement.

7. The device in accordance with claim 1, wherein the injector and the switch are arranged in a common housing that comprises an input line, an output line, and a connection to ground.

8. The device in accordance with claim 7, wherein the first current measurement of the evaluation unit is arranged at the input line and the second current measurement of the evaluation unit is arranged at the output line of the housing.

9. The device in accordance with claim 7, wherein the ground is connected to the second contact of the switch.

10. The device in accordance with claim 1, wherein the injector is a solenoid valve injector in which a solenoid valve is adapted to initiate a state change of the injector that in turn also effects a state change of the switch.

11. The device in accordance with claim 1, wherein the switch changes its state due to a movement of an injector component.

12. The device in accordance with claim 1, wherein the injector is a common rail injector.

13. A method for state detection of an injector for injecting fuel into an engine combustion chamber, the method comprising:

performing a first current measurement to measure a sum of a current ($I_{HS}$) flowing into the injector and a current ($I_{CT}$) flowing into a switch, the switch adapted to change its switch state in dependence on a state of the injector;

measuring only current ($I_{LS}$) flowing through the injector by a second current measurement; and drawing a conclusion on the current ($I_{CT}$) actually flowing through the switch from a difference of the first current measurement from the second current measurement.

14. The method in accordance with claim 13, wherein a result of the difference of the first current measurement from the second current measurement is subjected to a filtering.

15. An internal combustion engine having the device in accordance with claim 1.

16. The device in accordance with claim 11, wherein the switch changes its state due to a movement of a valve needle of the injector.

* * * * *